US008889226B2

(12) United States Patent
Walker et al.

(10) Patent No.: US 8,889,226 B2
(45) Date of Patent: Nov. 18, 2014

(54) METHOD OF BONDING A METAL TO A SUBSTRATE

(75) Inventors: Michael J. Walker, Shelby Township, MI (US); Bob R. Powell, Jr., Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 266 days.

(21) Appl. No.: 13/310,135

(22) Filed: Dec. 2, 2011

(65) Prior Publication Data

US 2012/0301743 A1 Nov. 29, 2012

Related U.S. Application Data

(60) Provisional application No. 61/488,967, filed on May 23, 2011.

(51) Int. Cl.

| | |
|---|---|
| ***B05D 1/36*** | (2006.01) |
| ***C23C 16/00*** | (2006.01) |
| ***B21C 37/00*** | (2006.01) |
| ***B82Y 30/00*** | (2011.01) |
| ***B82Y 40/00*** | (2011.01) |
| ***C23F 1/02*** | (2006.01) |
| ***B22D 19/08*** | (2006.01) |
| ***C23C 6/00*** | (2006.01) |

(52) U.S. Cl.

CPC . *B22D 19/08* (2013.01); *C23C 6/00* (2013.01); *Y10S 977/89* (2013.01); *Y10S 977/891* (2013.01); *Y10S 977/762* (2013.01); *Y10S 977/781* (2013.01)

USPC ..... 427/265; 427/248.1; 428/608; 977/890; 977/891; 977/762; 977/781

(58) Field of Classification Search

CPC ..... B32B 15/00; B32B 15/02; B32B 7/04; B82Y 30/00; B82Y 40/00; C23C 2/00; C04B 41/52; C23F 1/02

USPC ..... 427/299, 248.1, 265; 428/608; 977/890, 977/891, 762, 781

See application file for complete search history.

(56) References Cited

U.S. PATENT DOCUMENTS 3,069,209 A * 12/1962 Bauer ..... 92/169.1
4,127,451 A 11/1978 Marceau et al.

(Continued)

FOREIGN PATENT DOCUMENTS

DE 3616607 11/1986
DE 19606689 8/1996

(Continued)

OTHER PUBLICATIONS

Caffarena, Valeska da Rocha, et al., "Preparation of Electrodeposited Cobalt Nanowires", Materials Research, vol. 9, No. 2, 2006, pp. 205-208.

*Primary Examiner* — Timothy Meeks
*Assistant Examiner* — Ann Disarro
(74) *Attorney, Agent, or Firm* — Dierker & Associates, P.C.

(57) ABSTRACT

A method of bonding a metal to a substrate is disclosed herein. The method involves forming a nano-brush on a surface of the substrate, where the nano-brush includes a plurality of nano-wires extending above the substrate surface. In a molten state, the metal is introduced onto the substrate surface, and the metal surrounds the nano-wires. Upon cooling, the metal surrounding the nano-wires solidifies, and during the solidifying, at least a mechanical interlock is formed between the metal and the substrate.

10 Claims, 4 Drawing Sheets

(56) References Cited

U.S. PATENT DOCUMENTS

| | | | | |
|---|---|---|---|---|
| 5,131,987 | A | 7/1992 | Nitowski et al. | |
| 5,324,587 | A | 6/1994 | Nitowski et al. | |
| 5,486,283 | A | 1/1996 | Mnich | |
| 5,774,336 | A | 6/1998 | Larson | |
| 6,450,396 | B1 | 9/2002 | Krajewski | |
| 6,531,013 | B2 | 3/2003 | Nitowski | |
| 6,852,266 | B2 | 2/2005 | Robinson et al. | |
| 6,887,321 | B2 | 5/2005 | Parkos, Jr. et al. | |
| 2003/0209288 | A1 | 11/2003 | Huang | |
| 2007/0134555 | A1* | 6/2007 | Ren et al. | 429/245 |
| 2012/0086264 | A1 | 4/2012 | Carlson et al. | |
| 2013/0220821 | A1* | 8/2013 | Cho et al. | 205/122 |

FOREIGN PATENT DOCUMENTS

| | | |
|---|---|---|
| DE | 19615210 | 10/1997 |
| DE | 102004047299 | 12/2005 |
| DE | 112004002299 | 9/2006 |
| DE | 102008015333 | 10/2009 |
| EP | 0607579 | 7/1994 |
| EP | 1433553 | 6/2004 |
| EP | 1715085 | 10/2006 |
| GB | 1121228 | 7/1968 |
| GB | 2150603 | 7/1985 |
| WO | WO 2009/015329 | 1/2009 |

* cited by examiner

Fig-1G-A

METHOD OF BONDING A METAL TO A SUBSTRATE

CROSS REFERENCE TO RELATED APPLICATION

This application claims the benefit of U.S. Provisional Patent Application Ser. No. 61/488,967 filed May 23, 2011.

TECHNICAL FIELD

The present disclosure relates generally to methods of bonding a metal to a substrate.

BACKGROUND

Many automotive parts are fabricated from, for example, aluminum or steel. In some instances, it may be desirable to replace at least a portion of the aluminum or steel part with a lighter-weight material, such as magnesium. The presence of the lighter weight material may, in some cases, reduce the overall weight of the automotive part.

SUMMARY

A method of bonding a metal to a substrate is disclosed herein. The method involves forming a nano-brush on a surface of the substrate, where the nano-brush includes a plurality of nano-wires extending above the substrate surface. In a molten state, the metal is introduced onto the substrate surface, and the metal surrounds the nano-wires. Upon cooling, the metal surrounding the nano-wires solidifies, and during the solidifying, the metal forms at least a mechanical interlock between the metal and the substrate.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

FIG. 1G-A is an enlarged view of a portion of the schematic shown in FIG. 1G;

DETAILED DESCRIPTION

Figures 1A, 1B, 1C:
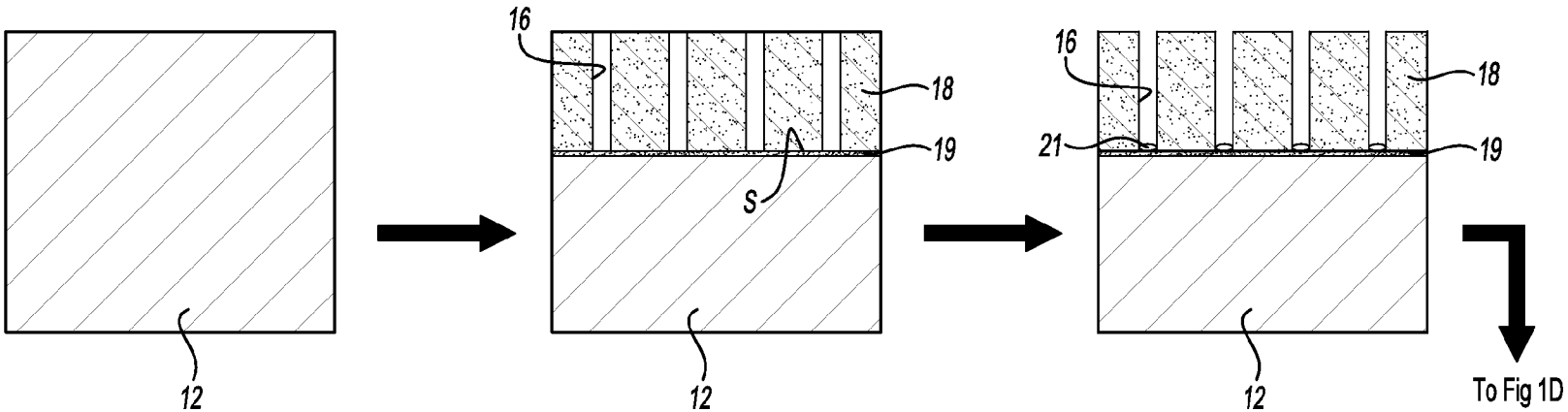
FIGS. 1A through 1G schematically depict an example of a method of bonding a metal to a substrate.

Aluminum and steel may be used to make various automotive parts, at least because these materials have a mechanical strength that contributes to the structural integrity of the part. It has been found that some of the aluminum or steel in a part may be replaced by lighter-weight material(s) (such as, e.g., magnesium). It is believed that the presence of the magnesium may, in some instances, reduce the overall weight of the automotive part.

It has been found that magnesium may be incorporated onto an aluminum or steel part via a casting process, such as a process known as over-casting. It has also been found that, in some instances, the magnesium may not metallurgically bond to the underlying aluminum or steel, at least not to the extent necessary to form a part that is considered to be structurally sound and usable in an automobile. For example, the aluminum may include a dense oxide surface layer (e.g., alumina) formed thereon, which, during casting, may prevent magnesium from metallurgically bonding to the aluminum underneath the oxide layer or directly to the oxide layer. More specifically, during the casting process, magnesium cannot penetrate the dense oxide layer and bond with the underlying aluminum in a manner sufficient to render the resulting part as structurally sound. As used herein, a part that is "structurally sound" is one that has mechanical properties that enable the part to withstand various operating stresses and strains incurred during use of the part.

Example(s) of the method disclosed herein may be used to form a part by creating a nano-brush on the surface of a substrate, and using the nano-brush to bond a metal (such as magnesium or magnesium alloys) to the substrate (such as aluminum, titanium, steel, etc.). The joint created between these materials is such that the part is considered to have the structural integrity necessary so that the part can be used in an automobile. In an example, the two materials may be joined together by improving the joint strength at an interface (i.e., its interfacial strength) between the metal and the substrate. This may be accomplished by manipulating the surface of the substrate so that the metal, when applied to the substrate in the molten state, at least can mechanically interlock with and bond to the substrate surface. In an example, the bond may be a physical bond, such as a mechanical interlock created by the metal penetrating the manipulated surface of the substrate. In some cases, a chemical bond may also form, such as a metallurgical bond formed between the metal and the substrate.

An example of the method of mechanically bonding a metal to a substrate will now be described in conjunction with FIGS. 1A-1G and 1G-A. In this example, the part 10 (shown in FIG. 1G) formed by the method includes a substrate and an over-casting metal bonded to the substrate. In one example, the substrate 12 is aluminum and the over-casting metal M is magnesium. It is to be understood that the method may also or otherwise be used to form parts made from other combinations of materials. For instance, the part 10 may be formed from other substrate materials that may be used for automotive applications (e.g., to make an automotive chassis component, an engine cradle, an instrument panel (IP) beam, an engine block, and/or the like). The substrate may, in some cases, be chosen from materials that are refractory enough so that the material does not melt when exposed to the molten metal during over-casting, details of which will be provided below at least in conjunction with FIG. 1F. The substrate materials are metals chosen from a metal, such as aluminum, zinc, magnesium, titanium, copper, nickel, and/or alloys thereof. It is to be understood that other substrate materials may also be used as appropriate with respect to the method disclosed herein, some examples of which include cast iron, superalloys (e.g., those based on nickel, cobalt, or nickel-iron), steel (which is an alloy of iron, carbon, and possibly other components), brass (which is a copper alloy), and non-metals (e.g., high melting temperature polymers, such as those polymers having a melting temperature of at least 350° C., glass, ceramics, and/or the like). The substrate material may otherwise be chosen from a material to make a part that is suitable for use in other applications, such as non-automotive applications including aircraft, tools, housing/building components (e.g., pipes), etc. In these applications, the substrate material may be chosen from any of the metals listed above, or may be chosen from another metal or non-metal (e.g., steel, cast iron, ceramics, high melting temperature polymers (such as, e.g., crystal polymers, polyimides, polyether imides, polysulfones, and/or other polymers having a melting temperature of at least 350° C.), etc.). The high melting temperature polymers may further include a protective layer and/or be cooled to prevent the polymer from melting and/or decomposing so that the combination of the polymer, protective layer, and the over-casting process does not significantly damage the substrate (i.e., the article formed by the substrate/over-cast metal system is still functional for its intended purpose).

If the substrate is chosen from a metal other than aluminum, the substrate material may, in an example, be aluminized (i.e., the formation of an aluminum or aluminum-rich alloy layer on the surface of the substrate material) to be used in the method disclosed herein. For instance, steel may be aluminized via hot-dipping the steel in an aluminum-silicon melt, which forms an aluminum layer on the steel surface. This aluminum layer may later be anodized to form alumina, as described in detail below. It is believed that other materials, e.g., titanium, copper, etc. may also be aluminized via hot-dipping or another suitable method such as, e.g., vapor deposition.

It is to be understood that an aluminum surface is not required to perform examples of the method disclosed herein. For instance, magnesium, titanium, or another metal may be oxidized to form an oxide layer within which nano-pores may be formed and used to ultimately form the nano-brush. It is to be understood that other systems may be used beyond over-casting magnesium onto aluminum or an aluminized surface so long as the surface is or may become porous.

In one example, the metal to be bonded to the substrate may be chosen from any metal in the periodic table of elements that has a melting point or temperature that is lower than, or near (e.g., within 1° C. of) the melting temperature of the substrate to which metal is to be bonded. It is to be understood that the over-cast metals discussed herein may be the pure metal or an alloy thereof. Further, the substrate material should be refractory enough so that it does not melt too severely during casting. It has been found that selecting metals having a lower melting point than the substrate enables casting to be accomplished without melting the underlying substrate. For example, magnesium may be selected as a metal to be over-cast on any of the substrate materials chosen from metals such as aluminum, zinc, titanium, copper, nickel, and/or alloys thereof at least in part because the melting temperature of magnesium is about 639° C. and is lower than any of the substrate materials. It is to be understood that magnesium may also be selected as the substrate material as discussed below. Some examples of combinations of the metal and substrate that may be used to form an automotive part, for instance, include i) magnesium and aluminum, respectively, and ii) magnesium and steel, respectively. Other examples of metals that may be chosen include aluminum, copper, titanium, and alloys thereof. If aluminum is selected as the over-cast metal, the aluminum may be bonded to substrate materials having a melting temperature that is lower than aluminum. For instance, aluminum (which has a melting temperature of about 660° C.) may be bonded to copper (which has a melting temperature of about 1083° C.), titanium (which has a melting temperature of about 1660° C.), or steel (e.g., stainless steel has a melting temperature of about 1510° C. and carbon steel has a melting temperature ranging from about 1425° C. to about 1540° C.). Further, if copper is chosen as the over-cast metal, then the copper may be bonded to titanium or steel at least in part because copper has a lower melting temperature than titanium and steel.

It is to be understood that, in some examples, the melting temperature of the over-casting metal does not have to be less than the substrate, at least in part because the substrate may include a protective layer, be subjected to cooling, and/or have a mass and conductivity that is sufficient to extract the heat of solidification before melting. For instance, aluminum (again, which has a melting temperature of about 660° C. may be over-cast on magnesium (which has a melting temperature of about 639° C.) if the over-casting is performed, e.g., in a die caster with a cooling mechanism to cool the magnesium.

As such, it is believed that the over-cast metal may otherwise be selected from a metal that has a higher melting temperature than the substrate. In this example, the substrate material may be cooled during the over-casting, and/or have a mass that is sufficient so that the molten over-cast metal solidifies before the metal deleteriously affects the structural integrity of the substrate, and/or have a protective layer thereon. In some instances, the heat transfer to the substrate may be low enough so that the temperature of the substrate does not reach its melting temperature, and thus will not melt (or melts slightly). In some instances, a coating (made from a material that has, e.g., a very high melting temperature (e.g., alumina)) may be established on the substrate that can reduce the heat transfer to the substrate. For example, alumina (which has a melting temperature of about 2072° C.) may be used as a suitable coating for the substrate. It is to be understood, however, that the coating material selected should also be durable and adherent so that the material can contribute to the structural integrity of the formed part.

Accordingly, in an example, when the metal is magnesium, the substrate may be chosen from aluminum, magnesium, zinc, titanium, copper, steel, and alloys thereof. In one instance, different alloys or compositions of magnesium may be used as the over-cast metal and the substrate material. The magnesium may be pure magnesium, or may be magnesium alloyed with at least one of aluminum, zinc, manganese, or suitable alloy material. For instance, magnesium alloy AM60 (which has a melting temperature of about 615° C.) may be over-cast onto an extruded AZ31B magnesium alloy tube (which has a melting temperature of about 630° C.).

In another example, when the metal is aluminum, the substrate may also be chosen from aluminum, magnesium, zinc, titanium, copper, steel, and alloys thereof.

While several examples have been given herein, it is to be understood that any combination of substrate and over-cast metal materials may be used so long as the casting procedure (e.g., casting temperatures, times, etc.) is such that over-casting may be accomplished without significantly damaging the substrate.

For purposes of illustration, the example of the method disclosed herein in conjunction with the FIG. 1 series (i.e., FIGS. 1A-1G) will be described below using aluminum as the substrate 12 (shown at least in FIG. 1A) and magnesium as the over-casting metal M (shown at least in FIG. 1F).

In an example, the method includes selecting a substrate 12 (shown in FIG. 1A), and then manipulating the surface S of the substrate 12 (as shown in FIGS. 1B-1E). The surface S may be manipulated, for instance, by forming a nano-brush 24 (shown in FIG. 1E) on the substrate surface S. As used herein, the term "nano-brush" refers to a cluster of nano-wires 22 formed on a designated portion of the substrate surface S, where the nano-wire cluster constructively forms a brush-like structure. Further, the term "nano-wire" refers to a structure having an effective diameter (recognizing that each wire may not have a perfectly circular cross section) that falls within the nanometer range (1 nm to 1000 nm). The nano-wires 22 may have a length that also falls within the nanometer range; however the nano-wires 22 may otherwise have a length that falls within the micrometer range (1 μm to 1000 μm). The nano-wires 22 may, e.g., be generally cylindrically shaped, and may be solid or hollow in cross section. In instances where the nano-wire 22 is hollow in cross section, the nano-wire 22 may also be referred to as a nano-tube. In instances where the nano-wire 22 is solid in cross section, the nano-wire 22 may also be referred to as a nano-pillar. The nano-wires 22 may also have substantially the same diameter throughout their length, or may have a shape where, e.g., the effective diameter of the nano-wire 22 is smaller at one end of the wire and larger at the other end of the wire. It is also contemplated that the nano-wires 22 may have a bulb-like shape, where the effective diameter near the mid-point of the length of the wire 22 is larger than that at both ends of the wire 22. The nano-wires 22 may also have a twisted shape depending, at least in part, on the shape of the nano-pore 16 within which the nano-wire 22 is grown. Further details of the nano-wires 22 will be described below in conjunction with FIG. 1G-A.

It is to be understood that the term "nano" when used in conjunction with the nano-brush 24 refers to the size (i.e., effective diameter) of the individual nano-wires 22 making up the brush 24. Although it is possible that the surface area of the nano-brush 24 may fall within the micrometer range (1 $\mu m^2$ to 1000 $\mu m^2$), it is possible that the surface area of the nano-brush 24 may be as large as that of the part 10 that is formed. In one example, upon forming an engine cradle, the nano-brush 24 may have a surface area as large as about 5 $cm^2$ to about 500 $cm^2$. It may also be possible, for some applications, for the nano-brush 24, as a whole, to fall within the nanometer range (e.g., from 10 nm to 1000 nm).

An example of forming the nano-brush 24 will now be described in conjunction with FIGS. 1B through 1E. The method includes forming a plurality of nano-pores 16 in the substrate surface S, as shown in FIG. 1B. In an example, the nano-pores 16 are formed by growing a porous metal oxide structure 18 on the substrate surface S via an anodization process. Briefly, anodization is the oxidation of a portion of the aluminum substrate 12 to form the structure 18 made of aluminum oxide (i.e., alumina). Thus, a portion of the aluminum substrate 12 is consumed as the aluminum oxide structure 18 grows. Anodization may be accomplished, for instance, by employing the aluminum substrate 12 as the anode of an electrolytic cell, and placing the anode and a suitable cathode in an aqueous electrolyte. Some examples of the electrolyte include sulfuric acid ($H_2SO_4$), phosphoric acid ($H_2PO_4$), oxalic acid ($C_2H_2O_4$), and chromic acid ($H_2CrO_4$). These electrolytes desirably form porous alumina; i.e., an alumina structure 18 including the nano-pores 16 formed therein. Further, any suitable cathode may be used, examples of which may include aluminum or lead. A suitable voltage and current (e.g., a DC current, or in some cases, a DC component and an AC component) is applied to the electrolytic cell for an amount of time to anodize a selected portion of the aluminum substrate 12 to grow the structure 18. In an example, from about 0.1 μm to about 50 μm of the aluminum substrate 12 is anodized depending, at least in part, on the desired thickness of the porous oxide layer 18 to be formed. For instance, it is believed that, for anodizing using a sulfuric acid electrolyte, every 3 μm of the oxide layer that is formed consumes about 2 μm of the underlying substrate 12. It is further believed that the foregoing ratio may change based, at least in part, on the porosity of the anodized layer and the mass balance of the metal oxide layer and the underlying substrate.

In an example, anodization may occur at a voltage ranging from about 1 V to about 120 V, and the voltage may be adjusted as desired throughout the anodization process as the oxide layer (or structure 18) grows thicker.

It is to be understood that other parameters may be adjusted, in addition to the voltage, to control the thickness of the oxide layer 18. For instance, the thickness of the oxide layer 18 depends, at least in part, on the current density multiplied by the anodization time. Typically, a particular voltage is applied in order to achieve the current density required to grow the oxide layer 18 to a desired thickness. Furthermore, the electrolyte used, as well as the temperature, may also affect the properties of the oxide layer 18, and the ability to grow and form the oxide layer 18 to a desired thickness. For instance, the thickness of the oxide layer 18 may depend on the conductivity of the electrolyte, which in turn depends on the type, concentration, and the temperature of the electrolyte. Further, the oxide layer 18 is electrically insulating, and thus at a constant voltage, the current density will decrease as the layer 18 grows. In some cases, the decrease in current density may limit the maximum growth of the oxide layer 18, and thus the voltage cannot always be continuously increased to increase the thickness of the layer 18. However, in some instances, it may be desirable to increase the voltage throughout the process. In one example, the voltage applied may start at about 25 V to about 30 V, and then the voltage may be ramped up to a higher voltage as the oxide layer 18 grows.

Additionally, the size of the nano-pores 16 may be controlled at least by adjusting the voltage, but the adjustment to the voltage may change depending on the material used (e.g., the substrate material). In one example, nano-pores 16 have an effective diameter D (shown in FIG. 1G-A) of about 1.29 nm per 1 V of voltage applied, and the spacing d between adjacent pores 16 is about 2.5 nm per 1V of voltage applied. The pore 16 size and spacing will be described in further detail below.

It is believed that the growth of the structure 18 (i.e., the porous aluminum oxide layer) depends, at least in part, on current density, the chemistry of the electrolytic bath (i.e., the electrolyte), the temperature at which anodization occurs, the amount of anodization time, and/or the voltage applied. In some cases, certain properties of the structure 18 may also be controlled by incorporating AC current in place of or superimposed onto the DC current. Furthermore, anodization may be accomplished at a temperature ranging from about −5° C. to about 70° C. (or, in another example from about −5° C. to about 10° C.), and the process may take place for a few minutes up to a few hours depending, at least in part, on a desired thickness of the structure 18 to be grown. In one example, the thickness of the oxide layer or structure 18 grown ranges from about 2 μm to about 250 μm. In another example, the thickness of the oxide layer or structure 18 grown ranges from about 40 μm to about 80 μm.

The porous oxide structure 18 formed via the anodization process described herein may include many nano-pores 16 defined therein, and a barrier layer 19 of alumina defining the bottom of each pore 16. The barrier layer 19 is a thin, dense layer (i.e., with little porosity, if any at all), and may constitute from about 0.1% to about 2% of the entire thickness of the oxide structure 18 formed.

As used herein, the term "nano-pore" refers to a pore having an effective diameter (knowing that each pore may not have a perfectly circular cross section) falling within the nanometer range (e.g., from 1 nm to 1000 nm); and the pore may extend at least partially through the oxide structure 18. In some cases, the oxide structure 18 may be etched to remove portions thereof at the bottom of the nano-pores 16 (including the barrier layer 19), thereby exposing the underlying aluminum substrate 12. Each nano-pore 16 has a substantially cylindrical shape that extends throughout the length of the pore (as schematically shown, e.g., in FIG. 2A), and the shape of the pore dictates the shape of the nano-wire 22 that will be grown within its respective pore 16, as described further below. It is to be understood that in one example, the shape of the nano-pores 16 depends, at least in part, on the anodization parameters as described above. In some instances, the effective diameter of each pore 16 is about the same, and the effective diameter is also substantially the same throughout the length of each pore 16. It is to be understood, however, that each nano-pore 16 may not necessarily have a diameter that is consistent throughout its length; e.g., one or more pores 16 may have a diameter that is smaller at the top of the pore 16 (e.g., the end of the pore opposed to the substrate surface S) and bigger at the bottom of the pore 16 (e.g., the end of the pore adjacent to the substrate surface S), or may have a bulb-like shape as described above for the nano-wire 22.

In an example, the effective diameter D (labeled in FIG. 1G-A) of each nano-pore 16 ranges from about 15 nm to about 160 nm. In another example, the effective diameter D of each nano-pore 16 ranges from about 25 nm to about 75 nm. In still another example the effective diameter D ranges from about 50 nm to about 150 nm.

Further, the diameter of the nano-pores 16 may vary through the height of the oxide structure 18 (e.g., where the nano-pores 16 have segments, along their length, with different diameters). This may be accomplished by growing the oxide layer 18 at a first voltage, where the pore 16 size attempts to reach a steady state. Then, during the process, a transition zone is created by changing the voltage so that the pores 16 attempt to reach another steady state. More specifically, the steady state diameters of the nano-pore 16 depend, at least in part, on the voltage. For instance, a first voltage may be used to grow the nano-pores 16 initially until a first steady state diameter is reached, and then a second voltage may be used for further growth of the nano-pores 16 until a second steady state diameter is reached. The transition zone of the first and second diameters of the nano-pores 16 occurs between the first and second voltages.

Across a substrate surface S, areas with and without nano-pores 16 may be formed. This may be accomplished using a mask. The mask prohibits pore formation and thus the masked areas include no nano-pores. These masked areas of the substrate surface S may be larger in scale (e.g., micrometers or even millimeters) than the size of the individual nano-pores 16 grown in the unmasked areas. Depending upon the mask used, this method can create discontinuous areas (i.e., nano-islands, discussed further hereinbelow) that contain nano-pores 16 or a continuous nano-pore-containing layer that has multiple holes (i.e., areas without nano-pores 16) formed therein. It is also contemplated herein to form nano-pores 16 across the substrate surface S having different dimensions. This may be accomplished, for example, by masking a first area of the surface S, and allowing the nano-pores 16 to grow in the unmasked area while applying a suitable voltage for growth. Thereafter, the area of the substrate surface S including nano-pores 16 grown therein may be masked to preserve the dimensions of these nano-pores 16. The previously masked area of the surface S is now unmasked. A different voltage may be applied to the newly unmasked area to grow nano-pores 16 of another desired size.

Figure 2A:
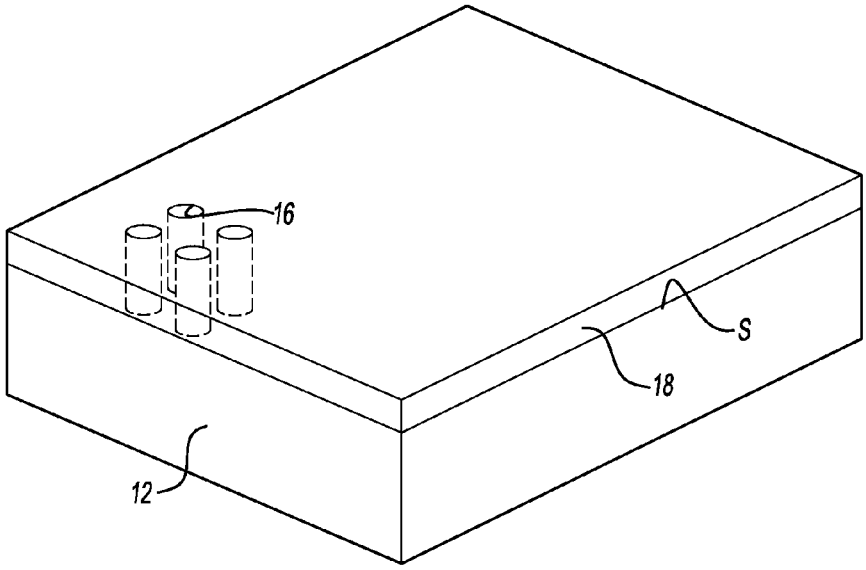
FIG. 2A is a perspective view schematically depicting an example of a substrate including a plurality of nano-pores formed in a surface thereof.
Figure 2B:
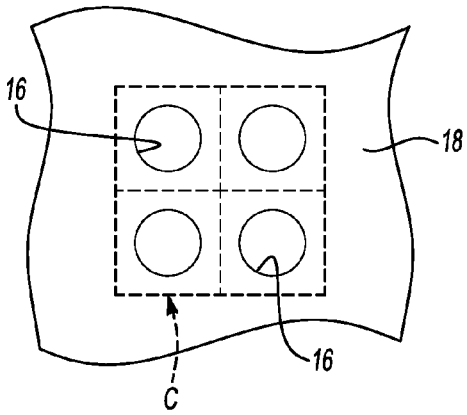
FIG. 2B is a plan view of the plurality of nano-pores shown in FIG. 2A.

The nano-pores 16 may be, for example, uniformly situated in the oxide structure 18, where the pores 16 are aligned. This is shown in FIG. 2A. In other words, the nano-pores 16 grow normal to the surface during the anodization process described above. It is to be understood that the nano-pores 16 may show some randomness, at least in terms of their respective positions in the oxide layer 18, and thus the configuration of the nano-pores 16 shown in FIG. 2A is not considered to be the typical case. It is further to be understood that certain positioning techniques may be applied in order to control the positioning of the nano-pores 16 in order to achieve a more uniform configuration, such as the one shown in FIG. 2A. The number of nano-pores 16 formed depends, at least in part, on the size (e.g., effective diameter) of each individual pore 16 and the surface area of the substrate surface S that is anodized. As one example, with 40 V of applied voltage, the number of nano-pores 16 formed ranges from about $1\times10^9$ to about $1\times10^{10}$ pores per $cm^2$ of the substrate surface. In one example, the surface area is as many as tens of squared centimeters. For example, the part 10 may have a surface area of about 200 $cm^2$, and thus the number of pores 16 is about $2\times10^{11}$. Further, if each pore 16 is defined inside a cell (such as the cell C shown in dotted lines in FIG. 2B), the size of each cell C may range from about 100 nm to about 300 nm. In an example, the spacing between adjacent pores 16 formed in the structure 18 ranges from about 100 nm to about 300 nm. In another example, the spacing between adjacent pores 16 ranges from about 180 nm to about 220 nm. In still another example, the spacing between adjacent pores 16 is about 200 nm. The spacing may be adjusted in a desirable manner so that the metal M can flow between adjacent nano-wires 22 in the nano-brush 24.

In some cases, it may be desirable to select certain portion(s) of the aluminum substrate 12 to which the magnesium (i.e., metal M) will be bonded, or to select where (on the aluminum substrate 12) to form the nano-pores 16. Thus, the part 10 may include a single nano-brush 24 that covers a selected portion of the substrate surface S or may include a plurality of nano-brushes 24 covering selected portions of the substrate surface S. The unselected portions of the substrate surface S are not anodized, and a nano-brush 24 is not formed in those unselected portions. This may be accomplished, for instance, by patterning the aluminum substrate 12 prior to growing the oxide structure 18 from it. Patterning may be accomplished via any suitable technique, and is used to perform localized anodization of the aluminum substrate 12. For instance, any standard photolithography method may be utilized, one example of which includes depositing a hard mask material on the aluminum, and then using a photoresist to pattern the mask material to allow localized exposure of the aluminum. In an example, the mask is patterned to expose portion(s) of the aluminum to the electrolyte from which the oxide structure 18 may be selectively grown. The areas that remain exposed once the mask and photoresist are in position may then be subject to local anodization, and the aluminum exposed via the patterned mask is locally anodized, for example, by employing the exposed or patterned aluminum layer as the anode of the electrolytic cell described above.

It is believed that patterning may also be used to alter a stress pattern at certain, perhaps critical, areas of the interface formed between the metal M and the substrate 12. These critical areas may be, for example, those areas that tend to be exposed to higher loads during use (such as, e.g., those surfaces exposed to wear or rolling contact). For instance, a strong bond may be formed at areas on the substrate surface S where there is a high density of nano-wires 22 (formed in the nano-pores 16) that the metal M can interact with during over-casting. Patterning (using a mask as described above) may be used, for instance, to reduce the number of pores 16 (and thus the number of nano-wires 22) at certain areas on the substrate surface S. This may be useful, for example, when it is desirable to transfer stress from the substrate 12 to the over-case metal M, or visa versa.

It is to be understood that the radius between certain section sizes may also be considered to be areas with increased stress. For these areas, patterning in combination with multiple anodization treatments using different voltages or times may create surfaces with different porous structures. For instance, a surface may be anodized a first time, and then a portion of the surface is masked. A second anodization treatment may then be applied to the unmasked portion of the surface using a different voltage than was used during the first anodization treatment. After the second anodization is complete, the area of the surface that was unmasked includes nano-pores 16 that vary in diameter along their respective lengths. The nano-pores 16 formed during the first anodization process in the masked area remain unchanged as a result of the second anodization process. As such, the nano-pores 16 in the masked area may include substantially uniform nano-pores 16 that are shorter or longer in length (depending, at least in part, on how the anodization voltage or time was changed during the second anodization treatment) than the nano-pores 16 formed in the non-masked area of the surface.

As briefly mentioned above, patterning may be used to create areas between clusters of nano-pores 16, where each cluster may be referred to as a nano-island. The nano-island is ultimately used to form a corresponding cluster of nano-wires 22 because the nano-wires 22 are formed in the pores 16 of the nano-island. It is believed that the presence of the nano-islands to create cluster(s) of nano-wires 22 surrounded by denuded areas (i.e., areas without any nano-wires 22) increases the surface area of the substrate surface S that the molten metal M may suitably penetrate during over-casting (e.g., by the flow of metal M between adjacent nano-wires 22). In an example, the porous nano-islands are formed by masking portions of the substrate surface S. The unmasked areas will undergo growth and nano-pore formation, and thus will become the nano-islands. The unmasked portions are anodized to form nano-pores 16 and nano-islands. It is to be understood that the term "nano" when used in conjunction with the porous nano-island refers to the size (i.e., effective diameter) of the individual nano-pores 16 formed in the nano-island. Although it is possible that the surface area of the nano-island may fall within the micrometer range (1 $\mu m^2$ to 1000 $\mu m^2$), the surface area of the nano-island may be as large as desired.

Also as briefly mentioned above, a continuous nano-porous layer may be formed that includes non-porous depressions/holes. This may be formed by masking the designated portions of the substrate surface S that will form the depressions, and exposing the unmasked portions of the surface S to anodization. The areas surrounding the depressions contain nano-pores 16, while the depressions do not contain nano-pores 16. The size of the depressions may also be in the nanometer scale, but may also be as large as desired. Further, the depressions may take any shape or form, such as circles, squares, straight lines, squiggly lines, a flower shape, etc., and may contribute to the increased surface area of the substrate surface S that the molten metal M may penetrate during over-casting. In an example, the nano-wires 22 can be formed in the nano-pores 16 alone. It is believed that the nano-wires 22 may, in some instances, be formed in both the nano-pores 16 and in the depressions (e.g., if a material for nano-wire growth is deposited therein).

Once the aluminum oxide structure 18 has been formed, a material 21 is deposited into each of the nano-pores 16 formed in the oxide structure 18, as shown in FIG. 1C. Deposition of the material 21 may be accomplished using any suitable deposition technique, examples of which include chemical vapor deposition (CVD), physical vapor deposition (PVD), electrochemical deposition, chemical polymerization, electroless deposition, or via sol-gel chemistry.

The material 21 is a material from which a nano-wire 22 may be grown through the pore 16 within which the material 21 is deposited. This material 21 may be chosen from a metal, metal oxide, or ceramic. In some instances, the material 21 may also be chosen from multiple metals, multiple metal oxides, or combinations of metal(s) and metal oxide(s). Further, the material 21 may be chosen from a metal or metal oxide that wets the over-casting metal M, and thus the nano-wire 22, when grown, is considered to be self-wetting to the over-casting metal M. In instances where the material 21 is not self-wetting, the nano-wire 22 grown from the material 21 may be coated with a wetting agent to impart a wetting characteristic to the nano-wires 22. Some examples of metals or metal oxides from which the material 21 may be chosen include carbon, nickel, silicon, manganese, tin, titanium, zinc, manganese oxides, silicon oxides, tin oxides, sodium oxides, and zinc oxides. Combinations of these metals and/or metal oxides may also be used as mentioned above.

The material 21 may be deposited via the methods described above as particles or atoms, or in another suitable form such as in the form of a powder. It is to be understood that the composition of the material 21 also makes up the composition of the nano-wire 22 that selectively grows from the deposited material 21.

Figures 1D, 1E, 1F:
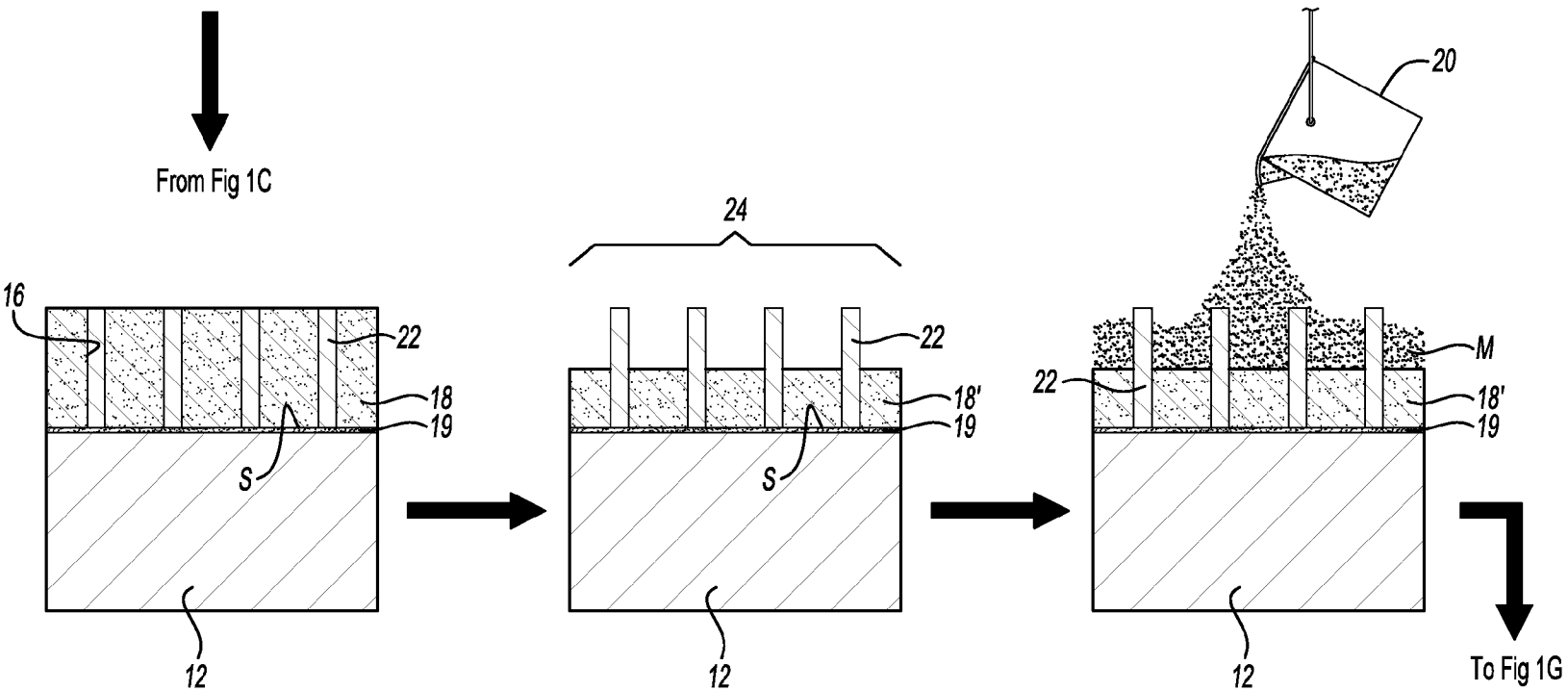

Referring now to FIG. 1D, a nano-wire 22 is grown from the material 21 deposited in the nano-pores 16 of the porous oxide structure 18. The nano-wires 22 may be grown via a number of processes known in the art, examples of which include electrochemical deposition, chemical vapor deposition, and/or physical vapor deposition.

As previously mentioned, a nano-wire 22 grows through each nano-pore 16 defined in the oxide structure 18, as shown in FIG. 1D. It is to be understood that the wires 22 conform to the geometry and/or dimensions of the nano-pores 16 within which the wires 22 are growing. The orientation of the nano-wires 22 may be controlled by the orientation of the pores 16. For instance, if the pores 16 are oriented perpendicular (i.e., about 90°) to the substrate surface S (as shown, e.g., in FIG. 1B), the nano-wires 22 will also be oriented perpendicular to the surface S (as shown, e.g., in FIG. 1D). In some instances, the nano-wires 22 will form a tangled structure which may provide a more effective mechanical interlock. In an example, the nano-wire 22 has an effective diameter ranging from about 15 nm to about 160 nm, which is also the effective diameter of the nano-pore 16 within which the wire 22 is grown. In another example, the effective diameter D of each nano-wire 22 ranges from about 25 nm to about 75 nm. In still another example the effective diameter D of each nano-wire 22 ranges from about 50 nm to about 150 nm.

As shown in FIG. 1D, the nano-wires 22 grow through the entire thickness of the oxide structure 18 so that the height of the nano-wires 22 is substantially the same as the height of the nano-pores 16. In an example, the height of the nano-wire 22 ranges from about 2 μm to about 250 μm, which is about the same as the thickness of the oxide structure 18 as well as the height of the pore 16. Then, as shown in FIG. 1E, a portion of the oxide structure 18 is selectively removed to expose at least a portion of each of the nano-wires 22, and the portion of the oxide structure that remains is identified by reference numeral 18' in FIG. 1E. In an example, the remaining portion of the oxide structure 18' is about half of the thickness of the original oxide structure 18. It is to be understood, however, the amount of the oxide structure 18 that may be removed depends, at least in part, on the strength requirements of the part 10 to be formed. In other words, the amount of the nano-wires 22 exposed is sufficient to create a suitable interfacial bond between the over-casting metal M and the substrate 12 that meets any structural requirements necessary for the part 10 that is formed. In an example, at least about 50% of the nano-wire 22 is exposed upon etching the structure 18. In another example, about 10% to about 90% of the nano-wire 22 is exposed upon etching the structure 18. Further, upon removing the portion of the original oxide structure 18, a nano-brush 24 is formed that includes the remaining portion of the oxide structure 18' (which forms the base of the nano-brush 24) and the exposed portion of the nano-wires 22 (which form the bristles of the nano-brush 24). In an example, removal of the oxide structure 18 is accomplished via a selective etching process utilizing an etching solution, such as KOH or NaOH.

Once the nano-brush 24 has been formed, the magnesium metal M is bonded to the substrate 12, as shown in FIG. 1F. This may be accomplished, for example, by placing the substrate 12 including the nano-brush 24 formed thereon in a casting die or mold (not shown in the figures), and then over-casting the magnesium metal M onto the substrate. It is believed that the magnesium metal M, which is over-cast while in a molten state, penetrates the spaces formed between adjacent nano-wires 22 in the nano-brush 24, and eventually surrounds the nano-wires 22. When clusters of nano-wires 22 or depressions are formed, the molten metal M will also penetrate those areas that do not contain any nano-wires 22. Furthermore, a layer 14 of the magnesium metal is formed over the nano-brush 24 according to the shape of the casting die or mold. It is to be understood that the layer 14 in combination with the aluminum substrate 12 makes up the part 10 (shown in FIG. 1G). Upon cooling, the magnesium metal M that flowed through the nano-brush 24 (e.g., into the spaces between the nano-wires 22) and over the nano-wires 22 is solidified to form layer 14. The solidification of the magnesium metal M inside the nano-brush 24 forms at least a mechanical interlock with the nano-brush 24. It is believed that this mechanical interlock imparts enough strength to the interface between the layer 14 and the substrate 12 that the part 10, as a whole, is structurally sound.

In some cases, the magnesium metal M may also chemically and/or metallurgically bond to the nano-wires 22, thereby improving the structural bond between the over-casting metal (making up the layer 14) and the underlying substrate 12.

As previously mentioned, the nano-wires 22 may be grown from a material 21 that is self-wetting to the over-casting metal M. In some cases, the oxide structure 18' remaining after etching that makes up the base of the nano-brush 24, and which comes into contact with the over-casting metal M, may also be self-wetting to the over-casting metal (such as the magnesium metal M). As used herein, the term "self-wetting" refers to the ability of the metal oxide making up the structure 18' to maintain contact with a liquid disposed thereon (e.g., the molten magnesium metal M). This contact is generally maintained at least in part because of the inter-molecular interactions of the two materials when they are brought together. So long as the surface (in this case, the structure 18') is self-wetting, the molten metal M may be directly applied to the substrate surface S (i.e., the nano-brush 24 formed thereon, which includes the self-wetting base (i.e., 18') and the self-wetting bristles (i.e., 22)).

In instances where the nano-wires 22 and/or the remaining oxide structure 18' exposed to the over-casting metal M is/are not self-wetting to the metal M, a wetting agent may be introduced onto the exposed surfaces of the nano-wires 22 and/or the structure 18' prior to bonding (e.g., prior to over-casting). The wetting agent may be chosen from any material that will suitably impart wetting characteristics to the surface upon which the metal M is to be applied, and which does not corrode or create other similar problems upon reacting with the surface. In one example, a metal oxide may be introduced (via, e.g., chemical vapor deposition, physical vapor deposition, electrodeposition, sputtering, coating via sol-gel chemistry, and/or the like) onto the exposed surfaces of the nano-wires 22 and/or the structure 18', which reacts with the oxide of the structure 18' and/or the metal or metal oxide of the nano-wires 22 to generate a reaction product that includes a characteristic for wetting the magnesium metal M to be applied to the otherwise non-self-wetting surface(s). Examples of the metal oxide that may be introduced include oxides of manganese, sodium, silicon, tin, cadmium, and zinc. In another example, another metal may be deposited onto the exposed surfaces to impart a wetting characteristic thereto. The other metal used to impart the wetting characteristic to the surface(s) may also contribute to the bonding strength of the mechanical interlock formed during the method. The other metal may be chosen from any metal that is soluble in the molten metal M, some examples of which include aluminum, manganese, zinc, sodium, silicon, tin, cadmium, molybdenum, and/or alloys thereof. It is believed that iron and/or nickel may also work in certain applications.

For some deposition processes, the amount of the wetting agent that may be deposited on the exposed surfaces of the structure 18' and/or wires 22 depends, at least in part, on the viscosity of the fluid (i.e., the sol-gel solution) and the amount of solids (i.e., the wetting agent in the sol-gel) in solution. In one example, the wetting agent is applied to the structure 18' is about 1 nm to about 50 nm thick.

It is to be understood that the wetting agent may also be applied to the structure 18 prior to formation of the nano-wires 22. In these instances, the wetting agent is exposed to the nano-pores 16. In instances where a sol-gel chemistry or other type of solution process is used to introduce the wetting agent into the nano-pores 16, it is assumed that the solution is self-wetting so that the solution can flow into the pores 16. In this case, the amount of solids in the sol-gel solution may be used to determine the coating thickness.

Still referring to FIG. 1F, the metal M may be applied via an over-casting process. Over-casting generally involves introducing (via, e.g., pouring, spraying, or injecting) the metal M (e.g., magnesium), in a molten state, over the aluminum substrate 12. As previously mentioned, the molten magnesium penetrates the nano-brush 24 by flowing around the nano-wires 22. In an example, solid magnesium is melted into the molten state by heating the magnesium above its melting temperature. Then, a casting tool 20 (such as a ceramic or metallic crucible or ladle, as shown in FIG. 1F) is utilized to pour the molten magnesium metal M over the aluminum 12 inside the casting die or mold. In some cases, the molten metal M may be introduced by placing the substrate 12 in a cavity (e.g., a mold) and then injecting the metal M into the cavity. In yet another example, a counter-gravity, low pressure die casting process may be used where the mold is above a bath of the molten metal M, and the metal M is introduced into the mold via a mechanical pump or by using a gas pressure on the bath to force the metal M up to the mold. The molten magnesium M flows over the nano-brush 24 and also forms the layer 14 over the nano-brush 24, as previously mentioned. In one example, the over-casting process is considered to be complete when the layer 14 having a desired thickness is formed over the nano-brush 24 and is solidified.

Figure 1G:
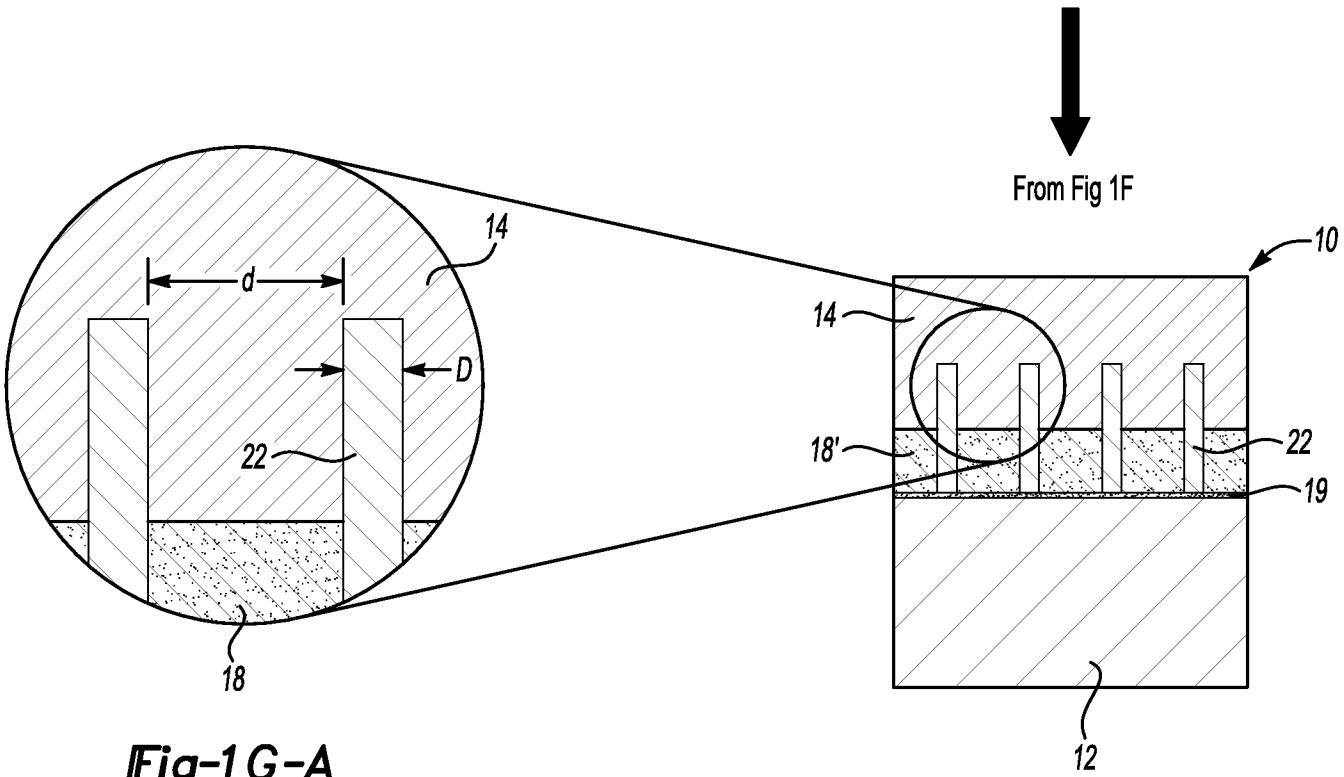

Referring now to FIG. 1G, the part 10 is formed upon solidifying the layer 14 (including the metal M in between the nano-wires 22 of the nano-brush 24) of magnesium bonded to the substrate 12 via, e.g., the over-casting method described above. In an example, solidification of the layer 14 includes passively cooling the metal M, which enables the molten metal to cool and solidify. Passive cooling of the metal M may be accomplished, e.g., via heat loss by natural radiation, convection, and/or conduction. In one example, these methods of heat loss may be accomplished by placing the part 10 at room temperature (e.g., at a temperature ranging from about 20° C. to about 30° C.). It is also contemplated that solidifying may also be accomplished by placing the part 10 into a cooler or other device to expose the part 10 to colder temperatures that may, in some instances, lessen the amount of time needed to fully solidify the metal. In yet another example, the part 10 may be cooled inside the casting die or mold by reducing the temperature of the die or mold. In still another example, the part 10 may be heated to at least 100° C. (or even up to about 300° C.) above room temperature (i.e., above about 20° C. to about 30° C.). The temperature at which the part 10 is heated is still lower than the solidification temperature of the metal, and thus the metal cools as heat is conducted into the substrate 12 and into the die/mold. The die/mold may be cooled using oil or water that passes through the die.

Other methods of forming a porous substrate surface from which the nano-brush 24 may be formed are also contemplated here, and are considered to be within the purview of the instant disclosure. It is to be understood that other methods may be used to form the oxide structure 18. Examples of other methods of forming the oxide structure 18 include depositing the oxide onto the surface of the substrate 12 or depositing a metal and then oxidizing it. Suitable deposition techniques include chemical vapor deposition, physical vapor deposition, thermal spraying, and a dipping process. For example, the dipping process may involve dipping the substrate 12 in a molten metal to create a thin metal layer on the surface S, and then oxidizing the metal. The pores 16 may then be formed in the deposited material, for example, via electro-discharge, a process utilizing a laser, and/or shot blasting. In one example, the pores 16 may then be formed in the oxide (to form the oxide structure 18) via electro-discharge using a suitable electrode. In still another example, electroplating may be used to deposit a material and during the deposition, pores 16 may form. If, for example, electroplating is used as a way of creating a porous surface, the porosity of the surface may be controlled using a patterning and/or masking process (such as lithography), sputtering of non-conductive materials, etc.

It is also to be understood that pores 16 may be formed in other non-oxide materials, such as metals. A metal substrate may be selected and then pores 16 may be formed in the surface using the techniques previously described.

The examples of the method have been described above for forming an automotive part. As previously mentioned, the examples of the method may also be used to form non-automotive parts, such as for aircraft, tools, house components (e.g., pipes), and/or the like.

It is to be understood that the ranges provided herein include the stated range and any value or sub-range within the stated range. For example, a thickness ranging from about 2 μm to about 250 μm should be interpreted to include not only the explicitly recited amount limits of about 2 μm to about 250 μm, but also to include individual amounts, such as 10 μm, 50 μm, 220 μm, etc., and sub-ranges, such as 50 μm to 200 μm, etc. Furthermore, when "about" is utilized to describe a value, this is meant to encompass minor variations (up to +/−20%) from the stated value.

It is further to be understood that, as used herein, the singular forms of the articles "a," "an," and "the" include plural references unless the content clearly indicates otherwise.

While several examples have been described in detail, it will be apparent to those skilled in the art that the disclosed examples may be modified. Therefore, the foregoing description is to be considered non-limiting.

The invention claimed is:

1. A method of bonding a metal to a substrate, comprising:

forming a nano-brush on a surface of the substrate, the nano-brush including a plurality of nano-wires extending above the substrate surface, the forming of the nano-brush including:

forming a plurality of nano-pores in the surface of the substrate;

depositing a material into the plurality of nano-pores;

growing a nano-wire in each of the plurality of nano-pores from the deposited material; and removing a portion of the substrate surface to expose the nano-wire grown therein;

in a molten state, introducing the metal onto the substrate surface, the metal penetrating spaces between each individual nano-wire in the plurality of nano-wires and surrounding each individual nano-wire in the plurality of nano-wires; and upon cooling, solidifying the metal surrounding each individual nano-wire in the plurality of nano-wires, wherein during the solidifying, forming at least a mechanical interlock between the metal and the substrate.

2. The method as defined in claim 1 wherein the forming of the plurality of nano-pores is accomplished by growing a structure including the plurality of nano-pores from the substrate surface via anodization.

3. The method as defined in claim 1 wherein the depositing of the material is accomplished by any of chemical vapor deposition, physical vapor deposition, electrodeposition, sputtering, coating via sol-gel chemistry, and combinations thereof.

4. The method as defined in claim 1 wherein the removing of the portion of the substrate surface is accomplished using an etching process.

5. The method as defined in claim 1 wherein prior to forming the nano-brush, the method further comprises patterning the substrate surface.

6. The method as defined in claim 1 wherein the material deposited into the plurality of nano-pores is chosen from one that wets the metal.

7. The method as defined in claim 6 wherein the material is chosen from any of carbon, nickel, silicon, manganese, tin, titanium, zinc, manganese oxides, silicon oxides, tin oxides, sodium oxides, and zinc oxides.

8. The method as defined in claim 1 wherein when the metal is magnesium, the substrate is chosen from aluminum, titanium, copper, steel, and alloys thereof.

9. The method as defined in claim 8 wherein when the substrate is chosen from titanium, copper, steel, and alloys thereof, the method further comprises aluminizing the surface of the substrate.

10. A method of bonding a metal to a substrate, comprising:

aluminizing a surface of a substrate chosen from titanium, copper, steel, and alloys thereof;

forming a nano-brush on the aluminized surface of the substrate, the nano-brush including a plurality of nano-wires extending above the substrate surface, wherein the surface of the substrate is aluminized prior to forming the nano-brush on the surface;

in a molten state, introducing the metal onto the substrate surface, the metal penetrating spaces between each individual nano-wire in the plurality of nano-wires and surrounding each individual nano-wire in the plurality of nano-wires; and upon cooling, solidifying the metal surrounding each individual nano-wire in the plurality of nano-wires, wherein during the solidifying, forming at least a mechanical interlock between the metal and the substrate.

* * * * *